US007850300B2

(12) United States Patent
Hiroki et al.

(10) Patent No.: US 7,850,300 B2
(45) Date of Patent: Dec. 14, 2010

(54) IMAGE FORMING APPARATUS

(75) Inventors: Masashi Hiroki, Yokohama (JP); Satoshi Kaiho, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 1015 days.

(21) Appl. No.: 11/619,717

(22) Filed: Jan. 4, 2007

(65) Prior Publication Data

US 2008/0165239 A1 Jul. 10, 2008

(51) Int. Cl.
*B41J 2/01* (2006.01)

(52) U.S. Cl. ..... 347/104; 347/101

(58) Field of Classification Search ..... 347/104, 347/101, 103, 85, 86; 271/4.01; 358/497
See application file for complete search history.

(56) References Cited

U.S. PATENT DOCUMENTS

| | | | | |
|---|---|---|---|---|
| 5,531,431 | A * | 7/1996 | Saito et al. | 271/4.01 |
| 6,213,464 | B1 * | 4/2001 | Inoue et al. | 271/248 |
| 2006/0181556 | A1 * | 8/2006 | Wanibuchi et al. | 347/8 |
| 2006/0187504 | A1 * | 8/2006 | Kawashima | 358/497 |
| 2008/0165215 | A1 | 7/2008 | Hiroki et al. | |
| 2008/0165218 | A1 | 7/2008 | Hiroki et al. | |
| 2008/0165220 | A1 | 7/2008 | Hiroki et al. | |
| 2008/0165231 | A1 | 7/2008 | Hiroki et al. | |
| 2008/0165236 | A1 | 7/2008 | Hiroki et al. | |
| 2008/0165238 | A1 | 7/2008 | Hiroki et al. | |
| 2008/0165240 | A1 | 7/2008 | Hiroki et al. | |
| 2008/0165241 | A1 | 7/2008 | Hiroki et al. | |
| 2008/0165242 | A1 | 7/2008 | Hiroki et al. | |

FOREIGN PATENT DOCUMENTS

| | | |
|---|---|---|
| JP | 2006-219235 | 8/2006 |
| JP | 2006-225075 | 8/2006 |

* cited by examiner

*Primary Examiner*—Manish S Shah
(74) *Attorney, Agent, or Firm*—Turocy & Watson, LLP

(57) ABSTRACT

An image forming apparatus includes an apparatus main body, a transport mechanism that is provided in the apparatus main body and transports a sheet, a recording head to record an image by discharging ink to the sheet transported by the transport mechanism, a sheet guide that is provided to be opposite to the recording head and guides the sheet, a transport roller provided at an upstream side of the sheet guide in a sheet transport direction, an ejection roller provided at a downstream side thereof, and a transport unit that integrates the medium guide, the transport roller and the ejection roller and is provided to freely come in and out of the apparatus main body.

10 Claims, 9 Drawing Sheets

IMAGE FORMING APPARATUS

BACKGROUND OF THE INVENTION

1. Field of the Invention

The present invention relates to an image forming apparatus for printing an image on a medium such as, for example, a printing sheet, and particularly to an image forming apparatus having a recording head of an ink-jet system.

2. Description of the Related Art

As this type of image forming apparatus, for example, as disclosed in JP-A-2006-219235, there is known one in which a transport path for transporting a sheet is included in an apparatus main body, and an image is formed by discharging ink from a recording head to the sheet transported through this transport path.

In general, a sheet guide (medium guide) is provided to be separate from and opposite to a recording head, and ink is discharged to a sheet guided along this sheet guide.

At the time of a printing operation, an ink mist is generated around the recording head, and especially the sheet guide is soiled with this ink mist. When the sheet guide is soiled with the ink mist, there is a fear that when a subsequent sheet is guided, the sheet is soiled.

Then, in the related art, the sheet guide is periodically cleaned.

However, in the related art, since the sheet guide is fixedly provided in the apparatus main body, in the case where the sheet guide is cleaned, it has been necessary that a cleaning tool is inserted in the apparatus main body and the work is performed in a narrow space. Thus, there has been a problem that the workability is poor, and the confirmation of a cleaning effect becomes difficult.

Incidentally, as another means for cleaning a sheet guide, a paper for cleaning (for example, a white paper) is made to pass a sheet guide, and the soil of the sheet guide is removed by this paper.

However, in this case, there is a problem that since the paper is wastefully used, this is uneconomical.

BRIEF SUMMARY OF THE INVENTION

An aspect of the invention has been made in view of such circumstances, and it is an object to provide an image forming apparatus in which a medium guide is taken out to the outside of an apparatus main body and its cleaning can be performed.

An image forming apparatus according to an aspect of the invention includes an apparatus main body, a transport device that is provided in the apparatus main body and transports a medium, a recording device to record an image by discharging ink to the medium transported by the transport device, a medium guide that is provided to be opposite to the recording device and guides the medium, a transport roller provided at an upstream side of the medium guide in a medium transport direction, an ejection roller provided at a downstream side thereof, and a transport unit that integrates the medium guide, the transport roller and the ejection roller and is provided to freely come in and out of the apparatus main body.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Hereinafter, embodiments of the invention will be described in detail with reference to the drawings.

Figure 1:
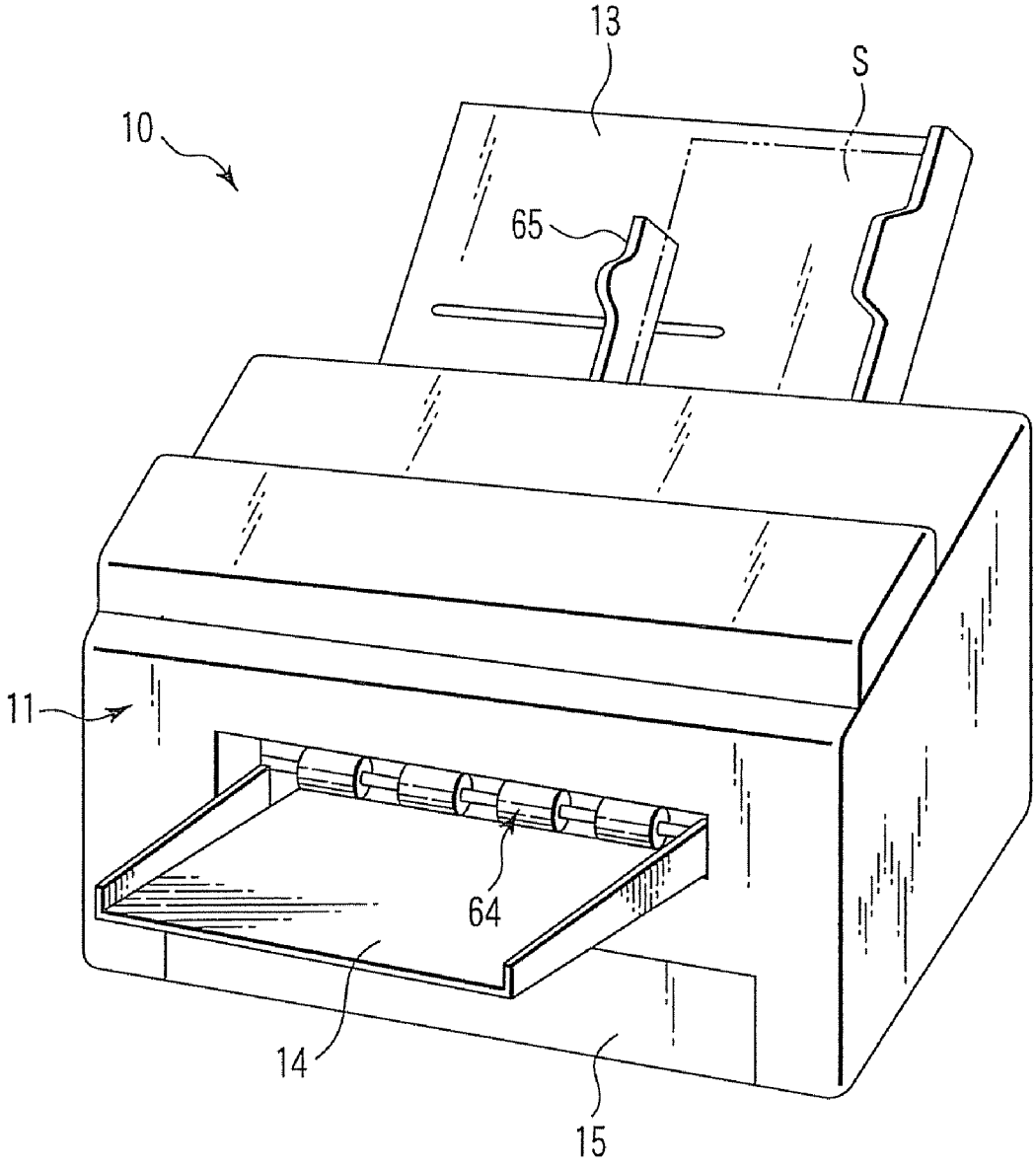
FIG. 1 is an outer appearance perspective view showing an image forming apparatus of a first embodiment of the invention.

FIG. 1 is an outer appearance perspective view showing an image forming apparatus of a first embodiment of the invention.

An image forming apparatus 10 includes an apparatus main body 11, and a first supply tray 13 is provided at a rear side of the apparatus main body 11, an ejection tray 14 is provided at a front side thereof, and a second supply tray 15 is provided at a lower side of the apparatus main body.

Figure 2:
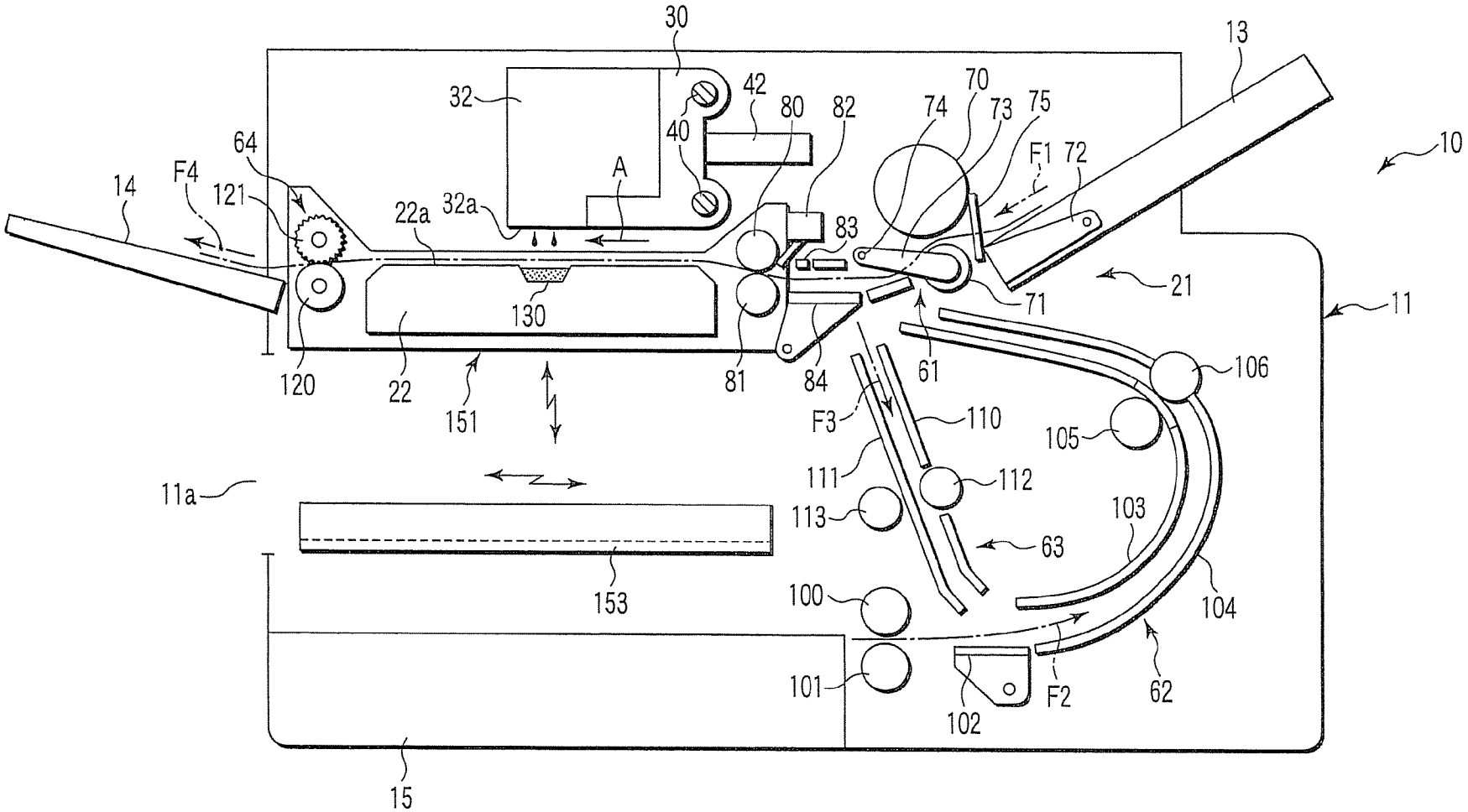
FIG. 2 is an inner structure view showing the image forming apparatus of FIG. 1.

FIG. 2 schematically shows the inner structure of the image forming apparatus 10.

Figure 3:
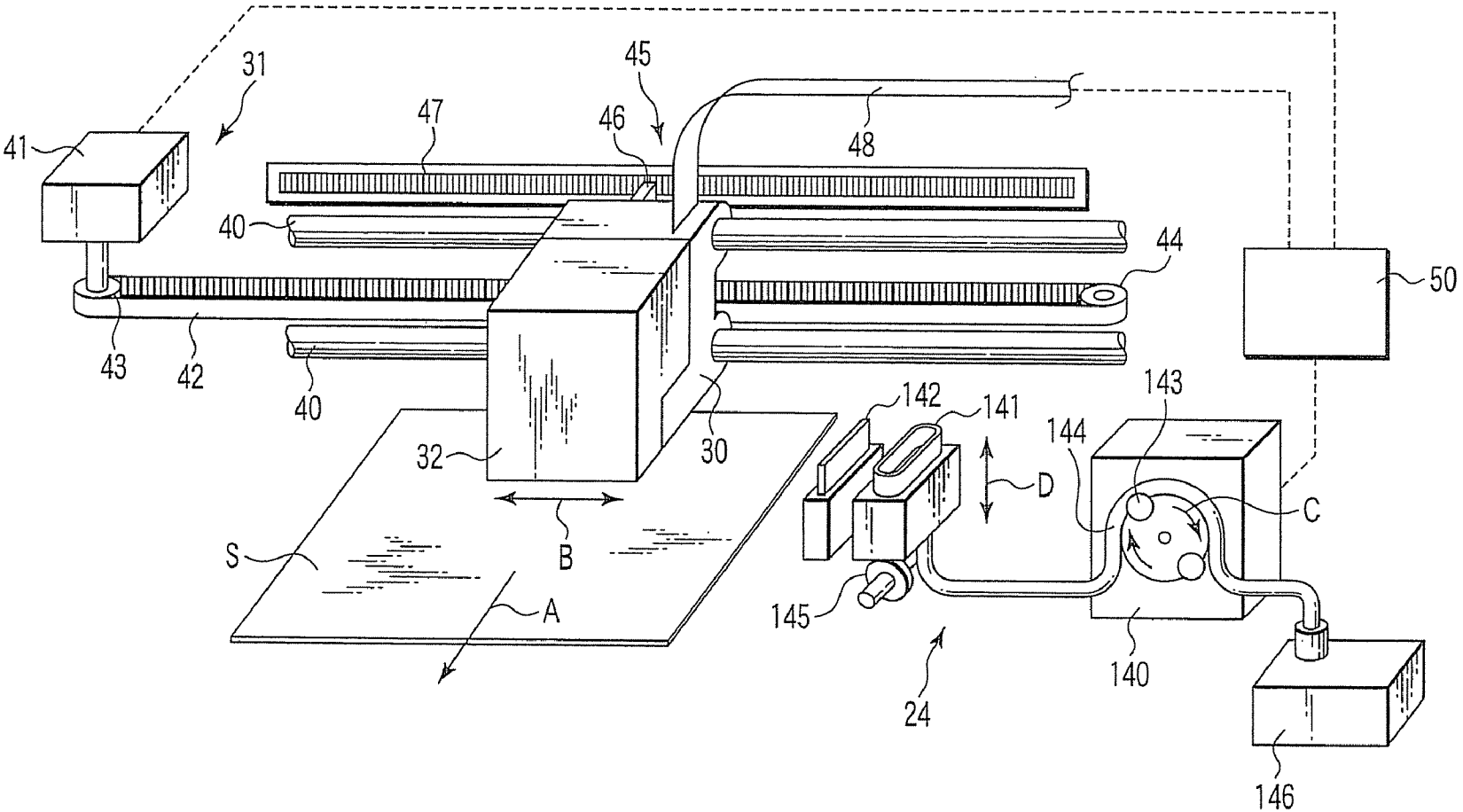
FIG. 3 is a perspective view showing a movement mechanism and a cleaning mechanism of a recording head of FIG. 2.

The apparatus main body 11 includes a sheet transport mechanism 21 as a transport device, a sheet guide 22 as a medium guide having a guide surface 22*a* in the horizontal direction, a head cleaning mechanism 24 shown in FIG. 3, and the like. The sheet guide 22 and the head cleaning mechanism 24 will be described later in detail.

A carriage 30, a carriage drive mechanism 31 to drive the carriage 30, a recording head 32 as a recording device of an ink-jet system mounted on the carriage 30 and the like are disposed at the upper side of the sheet guide 22. An exchangeable ink cartridge (not shown) is received in the recording head 32.

As shown in FIG. 2, the recording head 32 includes a nozzle unit 32*a* opposite to the guide surface 22*a* of the sheet guide 22, and an ink discharge mechanism (not shown) to discharge ink from the nozzle unit 32*a*. The recording head 32 forms an image on a sheet S (shown in FIG. 3) by this ink. An arrow A in FIG. 3 indicates a transport direction of the sheet S.

An example of the ink discharge mechanism includes a thermal type. In the thermal type, heat is applied to ink by a heater incorporated in the recording head 32, so that the ink is film-boiled. A change in pressure occurs in the ink by the growth or contraction of a bubble by this film-boiling. The ink is discharged from the nozzle unit 32*a* by this change in pressure, so that an image is formed on the sheet S. Other than the thermal type, an ink discharge mechanism using, for example, an element having a piezoelectric effect (for example, a piezoelectric element) may be adopted. For example, the piezoelectric element is deformed by an electric current, and ink is discharged from the nozzle unit by the pumping action based on the deformation.

As shown in FIG. 3, the carriage drive mechanism 31 includes a carriage guide 40 extending in the horizontal direction, a motor 41 such as a stepping motor, power transmission members such as a timing belt 42 and sprockets 43 and 44, a sensor unit 45 for controlling the position of the carriage 30, and the like. The carriage guide 40 extends in a direction B orthogonal to the transport direction of the sheet S. The carriage guide 40 is supported by a frame of the apparatus main body 11. The recording head 32, together with the carriage 30, can be reciprocated in the direction (arrow B direction) orthogonal to the transport direction of the sheet S along the carriage guide 40.

The rotation of the motor 41 is transmitted to the carriage 30 through the timing belt 42. Thus, the recording head 32 reciprocates along the carriage guide 40. The sensor unit 45 for controlling the position of the carriage 30 includes, for example, an encoder sensor 46 and a ladder plate 47 as a unit to be detected. The ladder plate 47 extends in the direction parallel to the carriage guide 40. The ladder plate 47 has a ladder pattern formed at an equal pitch. The ladder pattern of the ladder plate 47 is optically detected by the encoder sensor 46 according to the position of the carriage 30, so that the position of the carriage 30 is detected. A signal of the detected position is inputted to a control unit 50 through a flexible harness 48.

As shown in FIG. 2, the sheet transport mechanism 21 includes a first transport unit 61, a second transport unit 62, a two-sided printing transport unit 63 used when two-sided printing is performed, an ejection mechanism 64 and the like.

The first transport unit 61 transports the sheet taken out from the first supply tray 13 to the recording head 32. The second transport unit 62 transports the sheet taken out from the second supply tray 15 to the recording head 32. The ejection mechanism 64 has a function to eject the printed sheet onto the ejection tray 14.

Plural sheets (for example, printing sheets) are stacked in the thickness direction and can be placed on the first supply tray 13. As shown in FIG. 1, a movable guide 65 is provided on the first supply tray 13. The movable guide 65 can be moved in the width direction of the sheet S according to the size of the sheet S. The movable guide 65 is moved in the width direction of the sheet S, so that the position of the sheet S in the width direction on the first supply tray 13 can be regulated.

The first transport unit 61 includes a supply roller 70, a separation roller 71 positioned below the supply roller 70, a separation unit 72 including a separation pad, and the like. The supply roller 70 supplies the sheet taken out from the lower end of the first supply tray 13 to the recording head 32.

A torque limiter is provided on the separation roller 71. The separation roller 71 rotates in the same direction as the supply roller 70 by the function of the torque limiter in the case where only one sheet exists between the supply roller 70 and itself. In the case where two or more sheets exist between the supply roller 70 and the separation roller 71, the separation roller 71 rotates in the reverse direction to the supply roller 70. Accordingly, in the case where plural sheets are taken out from the first supply tray 13 and are sent to between the supply roller 70 and the separation roller 71, the sheet at the uppermost part and the other sheets are separated from each other, and only the sheet at the uppermost part is supplied to the recording head 32. The supply roller 70, the separation roller 71, the separation unit 72 and the like constitute a sheet separation mechanism to take out the sheet one by one from the first supply tray 13.

The separation roller 71 is held by a holder 73. The holder 73 can move in the up-and-down direction around a shaft 74 extending in the horizontal direction. The separation roller 71 is brought into contact with the supply roller 70 at a specified load by a spring and is separated from the supply roller 70 by a not-shown cam. The separation unit 72 can be moved by the not-shown cam in the direction of approaching or separating from the supply roller 70.

The separation roller 71 and the separation unit 72 are respectively separated from the supply roller 70 after the sheet is supplied, are moved to a standby position and are on standby until the time of next sheet supply. A return lever 75 is rotatably arranged in the vicinity of the lower end of the first supply tray 13. The return lever 75 is retracted by a spring to a position where the transport of the sheet is not prevented when the sheet taken out from the first supply tray 13 is transported to the supply roller 70. The return lever 75 is rotated in synchronization with the movement of the separation roller 71 and the separation unit 72 to the standby position, and returns the remaining sheet to the first supply tray 13.

The first transport unit 61 includes a transport roller 80, a pinch roller 81 opposite to the transport roller 80, a sheet sensor 82, a media sensor 83, a switching member 84 and the like. The transport roller 80 supplies the sheet to between the sheet guide member 22 and the recording head 32. The sheet sensor 82 includes a sensor arm capable of detecting the positions of the front end and the rear end of the sheet.

The media sensor 83 has a function to detect the quality (for example, paper quality) of the sheet. For example, in the case where the surface of the sheet is made of a hygroscopic substance, a signal to increase the amount of ink to be discharged from the recording head 32 is outputted to the control unit 50. In the case of the sheet the surface of which is glossy, for example, a coat paper, control is performed so that a signal to decrease the amount of ink to be discharged from the recording head 32 is outputted to the control unit 50. In the case of color printing, based on the signal from the media sensor 83, the discharge ratio of plural color components may be adjusted.

Figure 4:
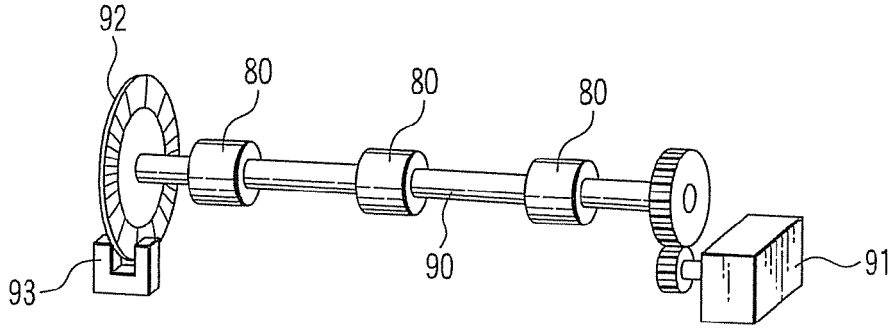
FIG. 4 is a perspective view showing a drive mechanism of a transport roller of FIG. 2.

As shown in FIG. 4, the transport roller 80 is attached to a shaft 90. The shaft 90 is rotated by a controllable motor 91 such as a stepping motor. The pinch roller 81 opposite to the transport roller 80 is in contact with the transport roller 80 by a not-shown spring. A disk-like ladder wheel 92 is attached to the shaft 90 of the transport roller 80. A ladder pattern is formed on the ladder wheel 92 in the circumferential direction at a constant pitch. The ladder wheel 92 is detected by a sensor 93, and the input is made to the control unit 50. By this, the rotation of the transport roller 80 is controlled, and the transport of the sheet is controlled at the time of image formation.

The sheet taken out from the first supply tray 13 by the supply roller 70 passes through the first transport unit 61 as indicated by an arrow F1 in FIG. 2 and is transported to between the transport roller 80 and the pinch roller 81. The leading end of the sheet is detected by the sheet sensor 82, and positioning for the image formation is performed. This sheet passes between the upper surface (guide surface 22*a*) of the sheet guide 22 and the recording head 32 by the rotation of the transport roller 80. At that time, the image formation is performed on the sheet S by the recording head 32. Ribs functioning as the transport reference surface are formed on the guide unit 22*a* of the sheet guide 22. These ribs hold the height of the sheet suitably and prevents the sheet from corrugating. The sheet on which an image has been formed is transported to the ejection mechanism 64.

The second transport unit 62 includes rollers 100 and 101 to take out the sheet from the cassette type second supply tray 15, a switching member 102, guide members 103 and 104 to guide the taken-out sheet, a transport roller 105 provided at the midway of the guide members 103 and 104, and a pinch roller 106 opposite to the transport roller 105. The pinch roller 106 is pressed to the transport roller 105 by a spring. Plural sheets (for example, printing sheets) are stacked in the thickness direction and can be contained in the second supply tray 15. The rollers 100 and 101 of the second transport unit 62 function as a sheet separation mechanism to take out the sheet one by one from the second supply tray 15.

The sheet taken out from the second supply tray 15 passes through the switching member 102 and passes the guide members 103 and 104 of the second transport unit 62 as indicated by an arrow F2 in FIG. 2. Further, this sheet is transported to the transport roller 80 by the rollers 105 and 106, and is supplied to between the recording head 32 and the sheet guide 22.

The two-sided printing transport unit 63 includes guide members 110 and 111, a transport roller 112 provided at the midway of the guide members 110 and 111, a pinch roller 113 opposite to the transport roller 112, and the like. The pinch roller 113 is pressed to the transport roller 112 by a spring. The guide members 110 and 111 are arranged between the switching member 84 of the first transport unit 61 and the switching member 102 of the second transport unit 62. At the time of two-sided printing, the sheet is made to pass in an arrow F3 direction in FIG. 2. The transport rollers 80, 105 and 112 are such that a rubber resin such as EPDM (ethylene propylene diene rubber) is provided on a metal shaft, and have a function to transport the sheet S by friction.

In the case where the two-sided printing is performed, after one side of a sheet is printed by the recording head 32, the rear end of this sheet is detected by the sheet sensor 82. Immediately after that, the transport roller 80 is reversely rotated, and the position of the switching member 84 is switched. By this, the sheet is sent to the two-sided printing transport unit 63 as indicated by the arrow F3 in FIG. 2. Further, this sheet is transported by the rollers 112 and 113, passes through the switching member 102, and passes the guide members 103 and 104 of the second transport unit 62. In this way, the sheet turns over, and this sheet is again sent to the recording head 32 by the transport roller 80, so that the other side of the sheet is printed.

The ejection mechanism 64 includes an ejection roller 120, a star wheel 121, a transmission mechanism (not shown) to transmit the rotation of the transport roller 80 to the ejection roller 120 and the star wheel 121, and the like. The star wheel 121 is a gear-like wheel made of a thin plate of stainless steel or the like. The sheet printed by the recording head 32 is pressed to the ejection roller 120 by the star wheel 121 and is transported in a direction indicated by an arrow F4 toward the ejection tray 14. The star wheel 121 prevents the sheet after printing from rising from the ejection roller 120.

Figure 5:
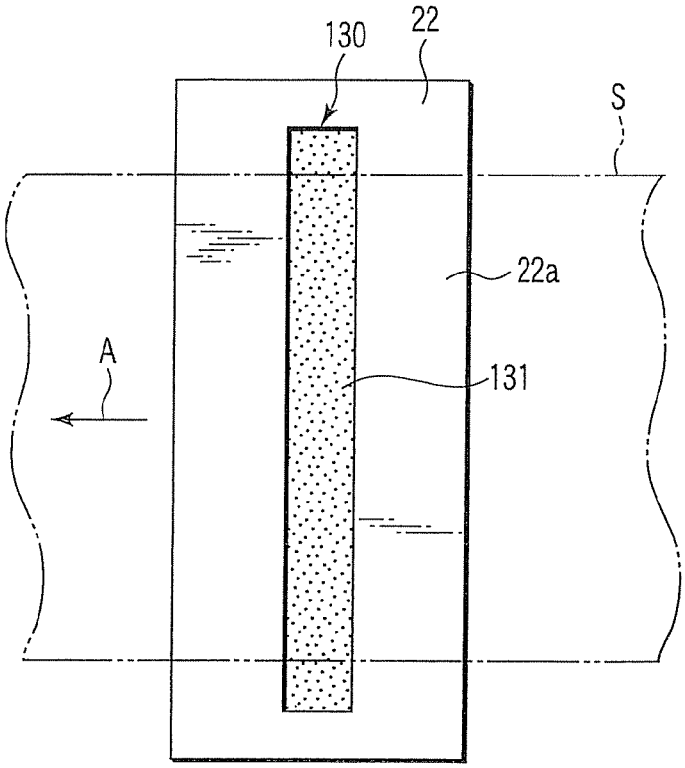
FIG. 5 is a plan view showing a sheet guide of FIG. 2.

As shown in FIG. 5, an ink absorption unit 130 is formed on the upper side of the sheet guide member 22. The ink absorption unit 130 is opposite to the nozzle unit 32*a* (shown in FIG. 2) of the recording head 32, and is formed at a position lower than the guide surface 22*a*. The width of the ink absorption unit 130 is larger than the width of the sheet S, and the ink absorption unit 130 contains, for example, a sponge-like ink absorption member 131. In the case where frameless printing of a sheet is performed, surplus ink protruding from the edge of the sheet is absorbed by this ink absorption member 131, so that it is prevented that a subsequent sheet is soiled.

The head cleaning mechanism 24 shown in FIG. 3 includes a suction pump 140 for cleaning the recording head 32, a cap 141 for preventing drying of the recording head 32, a blade member 142 for cleaning the nozzle unit 32*a* of the recording head 32, and the like. In an example of the suction pump 140, a tube 144 is squeezed in a direction indicated by an arrow C by a rotator 143, so that a negative pressure is generated inside the cap 141.

The cap 141 can be moved in the up-and-down direction (an arrow D direction in FIG. 3) by a drive unit 145. In the drive unit 145, for example, an electric actuator 446 such as, a solenoid is used as a drive source, and the cap 141 is moved up and down. Incidentally, the cap 141 may be moved up and down by converting the rotation of the motor into a linear movement by a cam or a link mechanism. When the recording head 32 is maintained, the cap 141 is raised to the recording head 32, so that the cap 141 is brought into close contact with the recording head 32. The suction pump 140 is actuated in this state, so that surplus ink attached to the nozzle unit 32*a* of the recording head 32 is sucked. The sucked waste ink is ejected into a waste ink tank 146. Thereafter, the cap 141 is separated from the recording head 32, and further, the nozzle unit 32*a* of the recording head 32 is cleaned by the blade member 142.

As shown in FIG. 2, the sheet guide 22, the transport roller 80 and the pinch roller 81 disposed at the upstream side of the sheet guide 22 in the sheet transport direction, and the ejection roller 120 and the star wheel 121 disposed at the downstream side thereof are integrated to constitute a transport unit 151. This transport unit 151 is provided to be freely come in and out of the apparatus main body 11.

The transport unit 151 comes in and out along the transport direction of the sheet. However, there is a fear that when being merely pulled out along the transport direction of the sheet, the transport unit 151 comes in contact with the recording head 32 and damages it.

Then, the transport unit 151 is once moved downward to go away from the recording head 32, and can be pulled out along the transport direction of the sheet.

That is, a horizontal guide unit 153 is provided in a lower part of the transport unit 151, and the transport unit 151 is guided in the up-and-down direction along a not-shown vertical guide unit between the home position and the horizontal guide unit 153. An opening 11*a* through which the transport unit 151 comes in and out is formed at the front side of the apparatus main body 11.

Figure 6:
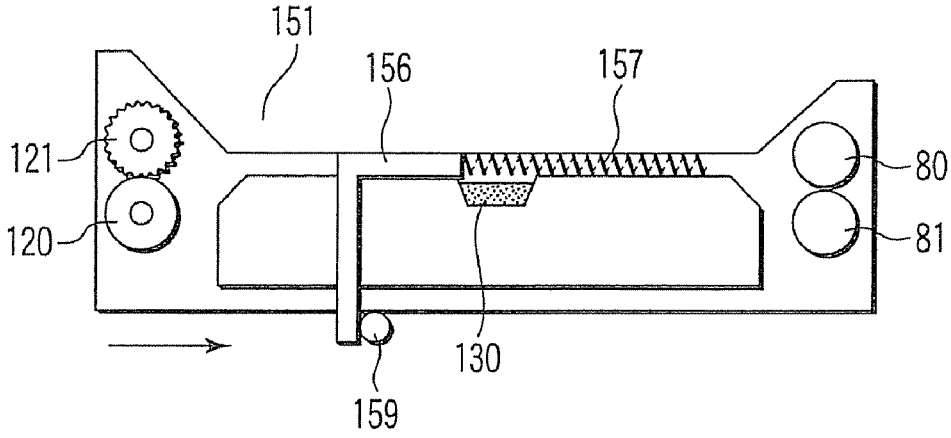
FIG. 6 is a view showing a state in which an opening and closing cover of an ink absorption member of FIG. 5 is opened.

As shown in FIG. 6, an opening and closing cover 156 for opening and closing the ink absorption unit 130 is provided in the transport unit 151. This opening and closing cover 156 is provided to be slidable in the transport direction of the sheet, and an end at its upper side is connected to a spring member 157 and is urged in the direction of closing the ink absorption body unit 130 as shown in FIG. 7.

A projection 159 is provided to protrude at the apparatus main body 11 side, and as described later, when the transport unit 151 is inserted into the apparatus main body 11, the lower end of the opening and closing cover 156 comes in contact with the projection 159. By this, as shown in FIG. 6, the opening and closing cover 156 is moved against the urging force of the spring member 157, and the ink absorption body 130 is made open.

Figure 7:
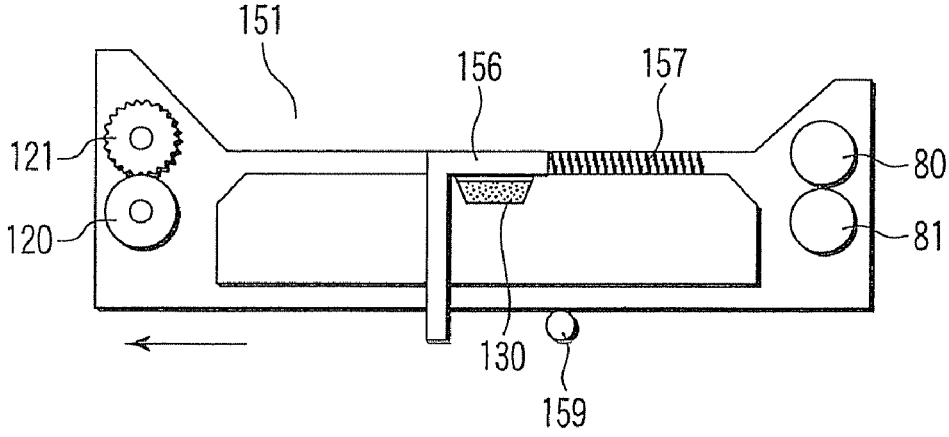
FIG. 7 is a view showing a state in which the opening and closing cover of the ink absorption member of FIG. 5 is closed.

When the transport unit 151 is pulled out from the apparatus main body 11, as shown in FIG. 7, the lower end of the opening and closing cover 156 is separated from the projection 159. By this, the opening and closing cover 156 is moved by the urging force of the spring member 157 and closes the ink absorption body 130.

At the time of printing, an ink mist is generated around the recording head 32, and especially the sheet guide 22 is soiled with this ink mist. When the sheet guide 22 is soiled with the ink mist, since a subsequent sheet is soiled when the sheet is guided, it is necessary to periodically clean the sheet guide 22.

Next, a cleaning method of the sheet guide 22 will be described.

Figure 8:
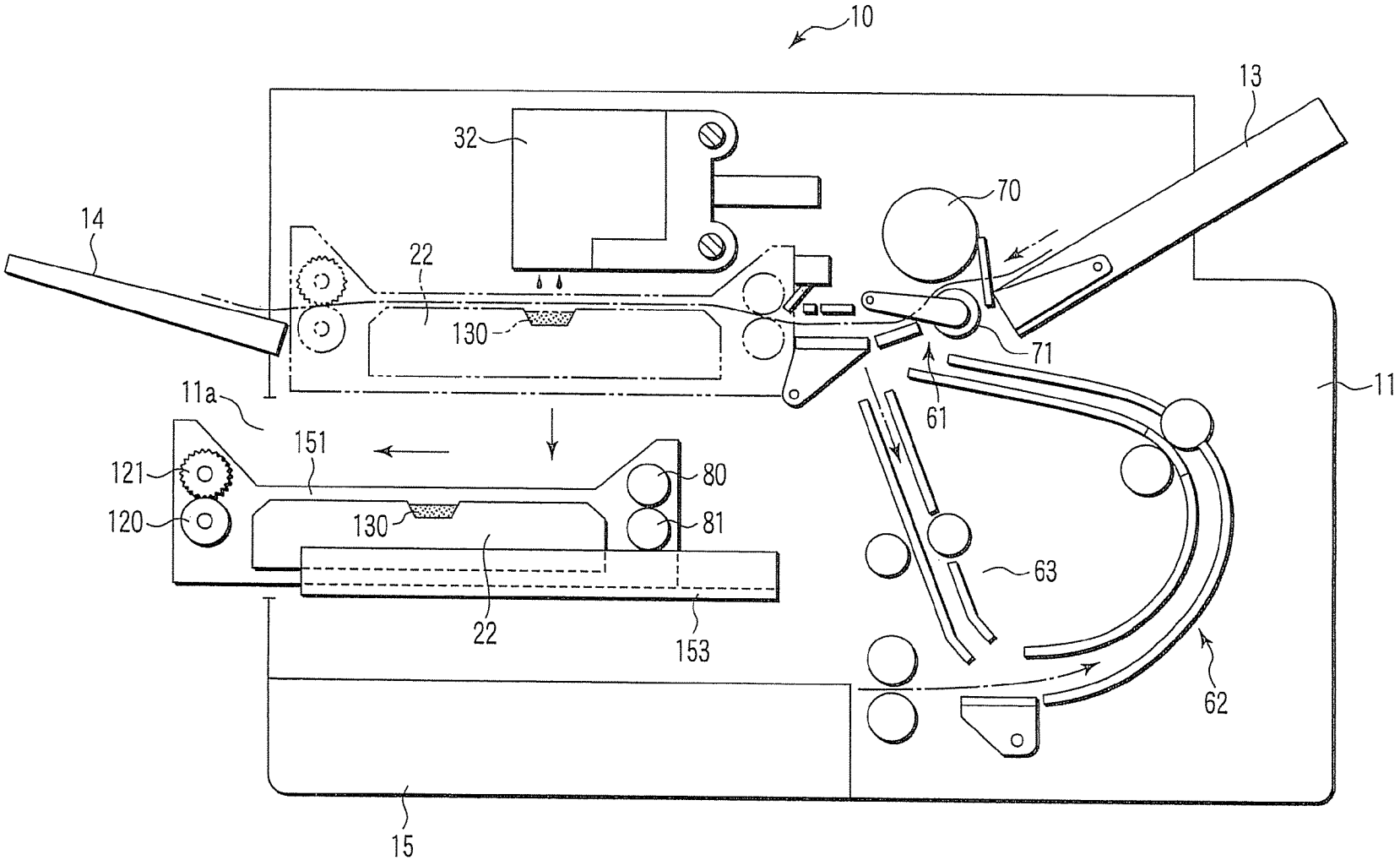
FIG. 8 is a view showing a state in which a transport unit of FIG. 2 is taken out from an apparatus main body.

In this case, first, as shown in FIG. 8, the transport unit 151 is moved downward along the not-shown vertical guide, is moved away from the recording head 32 and is placed on the horizontal guide 153. Next, the transport unit 151 is pulled out along the horizontal guide unit 153 and is taken out through the opening unit 11*a* of the apparatus main body 11. At the time of taking out, as shown in FIG. 7, the lower end of the opening and closing cover 156 is separated from the projection 159, the opening and closing cover 156 is moved by the urging force of the spring member 157, and the ink absorption unit 130 is closed. After the transport unit 151 is taken out to the outside in this way, the cleaning of the sheet guide 22 is performed, and further, the cleaning of the transport roller 80, the pinch roller 81, the ejection roller 120 and the star wheel 121 is also performed at the same time.

After the cleaning is ended, the transport unit 151 is inserted through the opening 11*a* of the apparatus main body 11, and then it is raised and is returned to the home position.

According to this embodiment, since the cleaning of the sheet guide 22 and the rollers 80, 81, 120 and 121 can be performed in the outside of the apparatus main body 11, there is a merit that the cleaning can be easily and certainly performed.

Besides, at the time of taking out the transport unit 151, as shown in FIG. 7, since the ink absorption unit 130 is closed by the opening and closing cover 156, a hand does not touch the ink absorption member 131 at the time of cleaning, and soil can be certainly prevented.

Figure 9:
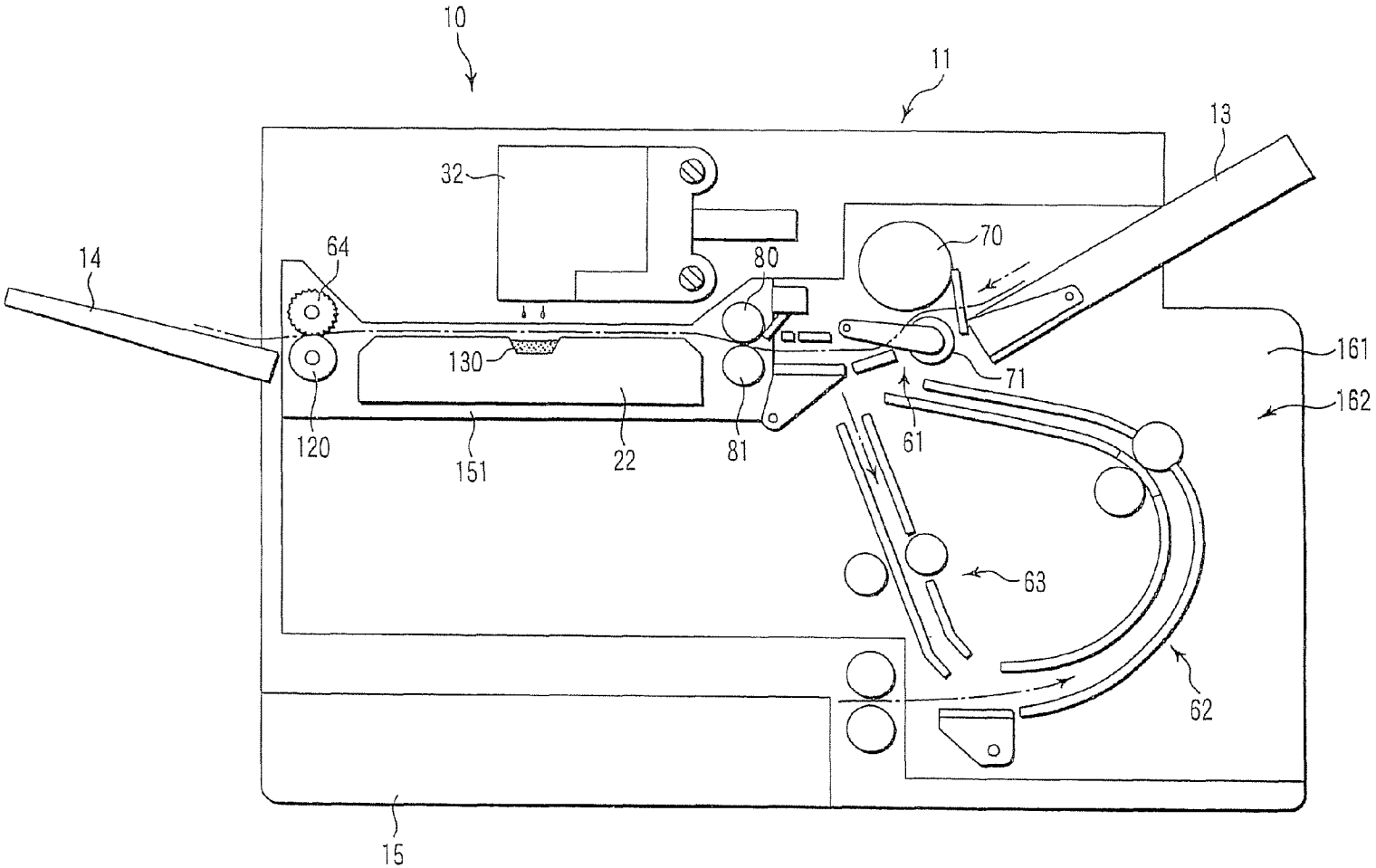
FIG. 9 is a view showing an image forming apparatus of a second embodiment of the invention.

FIG. 9 shows a second embodiment of the invention.

Incidentally, portions similar to those shown in the first embodiment are denoted by the same reference numerals and their description will be omitted.

In this second embodiment, a first supply tray 13, a first transport unit 61 (except a transport roller 80 and a pinch roller 81), a second transport unit 62, and a two-sided printing transport unit 63 are integrated to constitute a paper feed unit 161. The paper feed unit 161 is integrated with a transport unit 151 to constitute a path unit 162. This path unit 162 is provided to be freely come in and out of an apparatus main body 11. The transport unit 151 can be moved in the up-and-down direction along a not-shown vertical guide in the paper feed unit 161.

Next, a cleaning method of a sheet guide 22 will be described.

Figure 10:
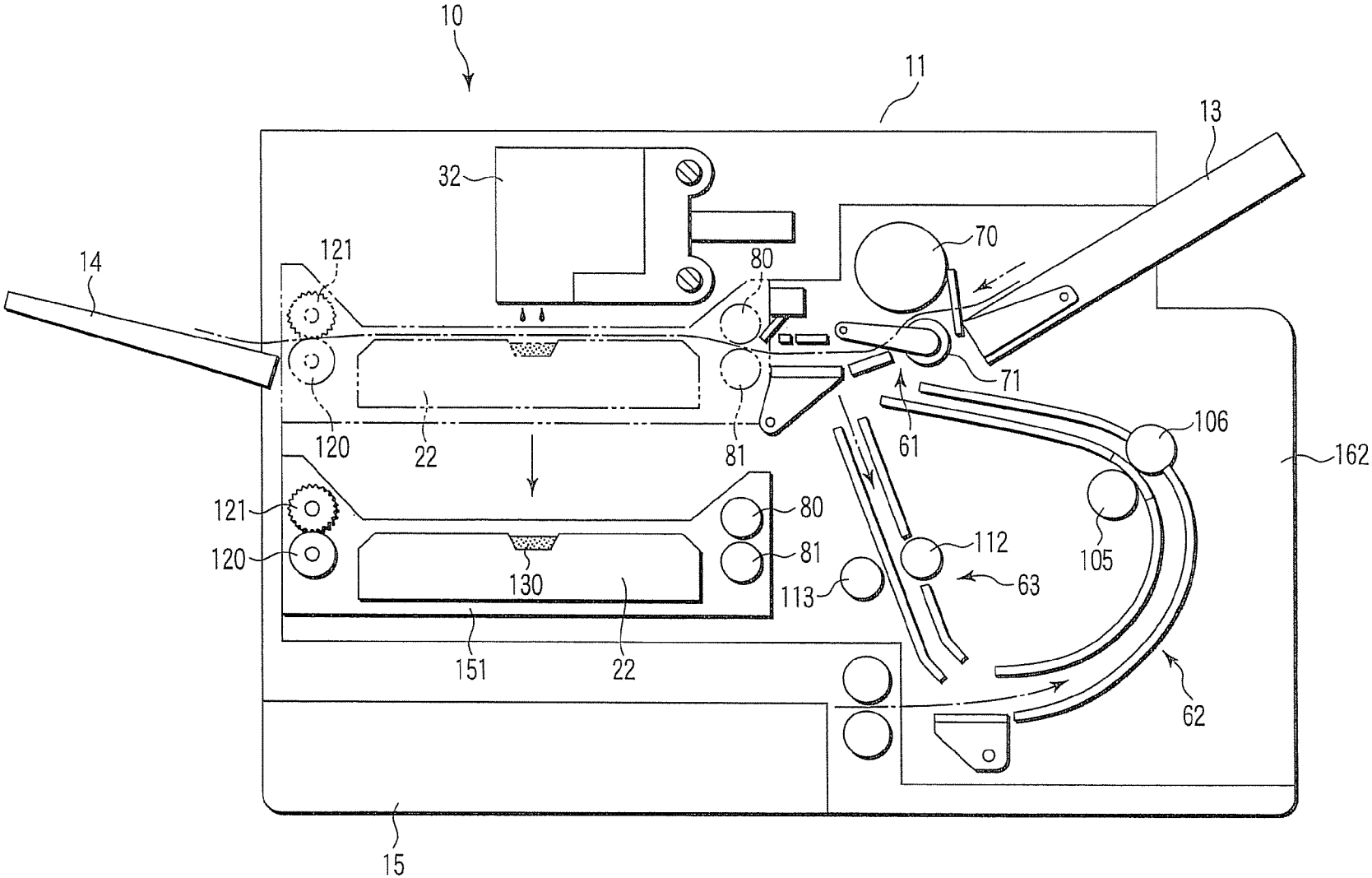
FIG. 10 is a view showing a state in which a transport unit of FIG. 9 is pulled down in a path unit.
Figure 11:
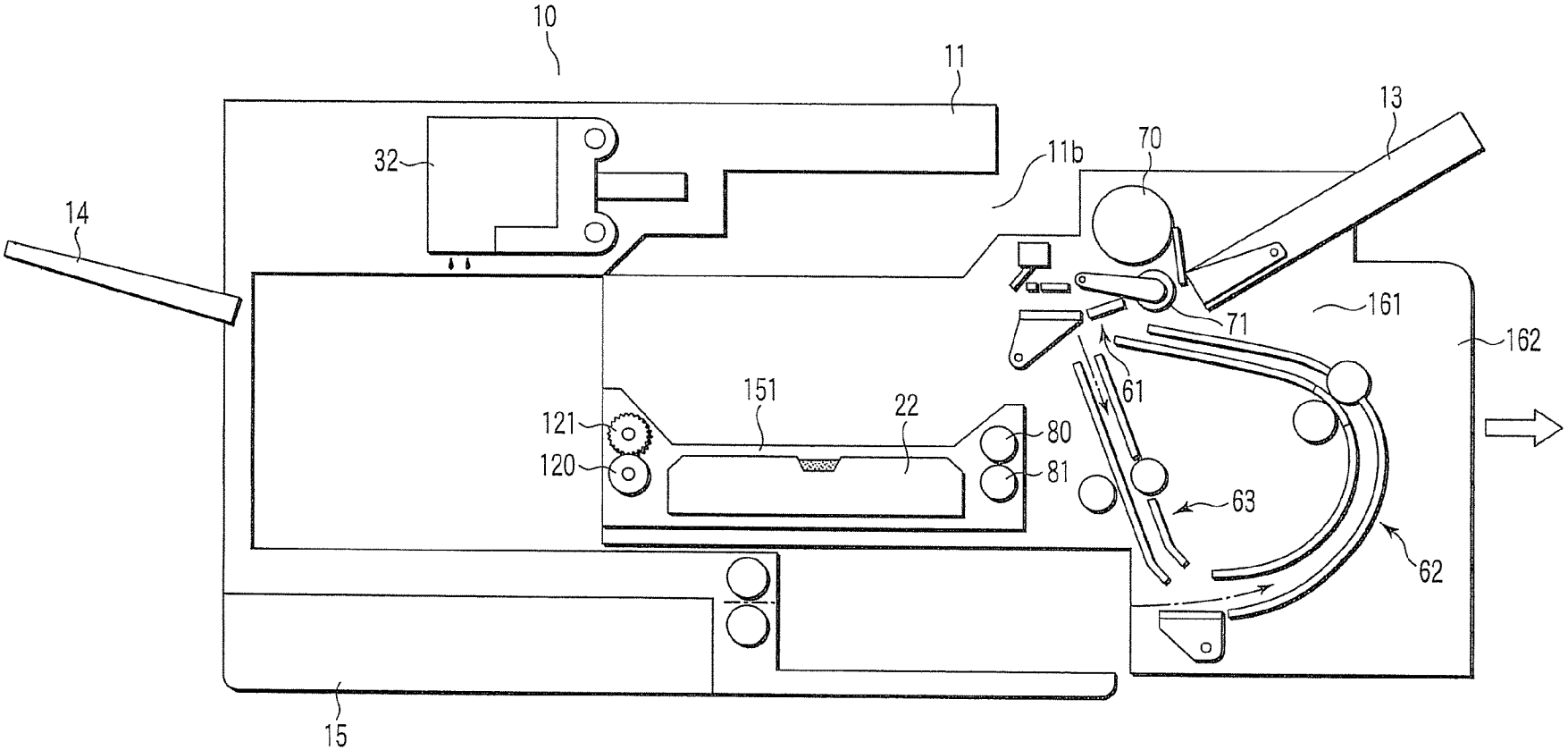
FIG. 11 is a view showing a state in which the path unit of FIG. 10 is pulled out from an apparatus main body.

In this case, first, as shown in FIG. 10, the transport unit 151 is moved downward along the not-shown vertical guide in the path unit 162 and is moved away from the recording head 32. Next, the path unit 162 is pulled out in the horizontal direction as shown in FIG. 11, and is taken out through an opening 11*b* of the apparatus main body 11. After the path unit 162 is taken out to the outside in this way, the cleaning of the sheet guide 22 of the transport unit 151 is performed, and further, the cleaning of the transport roller 80 and the pinch roller 81, and an ejection roller 120 and a star wheel 121 is also performed at the same time.

Besides, at this time, since the first transport unit 61, the second transport unit 62 and the two-sided printing transport unit 63 of the paper feed unit 161 are also taken out to the outside, the cleaning of the rollers in those units is also performed at the same time.

According to this second embodiment, since the cleaning of the sheet guide 22 and the rollers 80, 81, 120 and 121, and the first transport unit 61, the second transport unit 62 and the two-sided printing transport unit 63 can be performed outside a housing 20 of the main body unit 11, there is a merit that the cleaning becomes easy and certain.

Besides, also in the case where a sheet is jammed in the transport unit 151 or the paper feed unit 161, the path unit 162 is taken out to the outside, and the removal work can be performed outside the apparatus main body 11, and accordingly, the workability can be improved.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

an apparatus main body;

a transport device that is provided in the apparatus main body and transports a medium;

a recording device to record an image by discharging ink to the medium transported by the transport device;

a medium guide that is provided to be opposite to the recording device and guides the medium;

a transport roller provided at an upstream side of the medium guide in a medium transport direction;

an ejection roller provided at a downstream side thereof; and a transport unit that integrates the medium guide, the transport roller and the ejection roller, and is provided to freely come in and out of the apparatus main body.

2. The image forming apparatus according to claim 1, wherein the transport unit is once moved in a direction of moving away from the recording device in the apparatus main body and is taken out.

3. The image forming apparatus according to claim 1, wherein the medium guide includes an ink absorption member to absorb ink discharged to the medium and protruding from the medium.

4. The image forming apparatus according to claim 3, wherein the medium guide includes an opening and closing cover to open and close the ink absorption member based on an incoming and outgoing operation of the transport unit.

5. The image forming apparatus according to claim 1, wherein the ejection roller is a star wheel.

6. The image forming apparatus according to claim 1, wherein the recording device is a thermal type device.

7. The image forming apparatus according to claim 1, wherein the inkjet recording head generates an ink mist at a time of printing.

8. An image forming apparatus comprising:

an apparatus main body;

transport means provided in the apparatus main body and for transporting a medium;

recording means for recording an image by discharging ink to the medium transported by the transport means;

guide means provided to be opposite to the recording means and for guiding the medium;

a transport roller provided at an upstream side of the guide means in a medium transport direction;

an ejection roller provided at a downstream side thereof; and a transport unit that integrates the guide means, the transport roller and the ejection roller, and is provided to freely come in and out of the apparatus main body.

9. The image forming apparatus according to claim 8, wherein the transport unit is once moved in a direction of moving away from the recording means in the apparatus main body and is taken out.

10. The image forming apparatus according to claim 8, wherein the guide means includes an ink absorption member to absorb ink discharged to the medium and protruding from the medium.

* * * * *